United States Patent [19]

Davis et al.

[11] 4,293,835

[45] Oct. 6, 1981

[54] SOLENOID FOR AN ELECTRIC STARTING MOTOR FOR GARDEN TRACTOR OR THE LIKE

[75] Inventors: Robert K. Davis, Kankakee, Ill.; Michael J. Myers, Goshen, Ind.

[73] Assignees: Roper Corporation, Kankakee, Ill.; Electromation, Inc., Elkhart, Ind.

[21] Appl. No.: 115,875

[22] Filed: Jan. 28, 1980

[51] Int. Cl.[3] ..... H01H 50/02

[52] U.S. Cl. ..... 335/131; 335/126; 335/255

[58] Field of Search ..... 335/131, 126, 14, 251, 335/255, 202

[56] References Cited

U.S. PATENT DOCUMENTS

| | | | |
|---|---|---|---|
| 2,907,847 | 10/1959 | Grenier et al. | 335/131 |
| 2,933,573 | 4/1960 | Strider | 335/126 |
| 3,361,997 | 1/1968 | Freeman, Jr. | 335/126 |
| 4,213,108 | 7/1980 | Gross | 335/131 |

*Primary Examiner*—Harold Broome

*Attorney, Agent, or Firm*—C. Frederick Leydig; Richard L. Voit; David J. Richter

[57] ABSTRACT

A solenoid for an electric starting motor housed in a generally cylindrical plastic cup. A pair of diametrically arranged fixed contacts penetrate the end wall, forming binding posts for a load circuit. A magnetic sub-assembly is provided consisting of an armature and wound bobbin surrounded by a hollow magnetic annulus having axial clearance openings. A movable contact sub-assembly includes a conductive disc mounted on an axial plunger which is seated against the armature. The disc has, on its opposite side, a return spring. When control current is applied the armature is sucked into the annulus overcoming the force of the return spring and shifting the conductor disc into seated engagement with the fixed contacts thereby completing the load circuit. The disc and fixed contacts both have substantial axial and radial thickness providing high heat capacity as well as high conductivity for prompt dissipation of heat. The fixed contacts are spaced from the disc at such distance that only a minor portion of the presented area is engaged by the edge portion of the disc to develop high contact pressure per unit area. The disc is freely rotatable with respect to the fixed contacts so that contact occurs in random positions on the disc for constant renewal of the contacting surface.

14 Claims, 7 Drawing Figures

10
2.
3.
23
24
25
14
15
27
28
21
17
50
19
18
30
11
83
26
97
13
22
12
82
96
16
33
37
95
80
81

23
24
15
14
25
26
27
28
70
d
$t_2$
$t_1$
21
22
11
97
13
60
30
17
50
19
4.
31
18
12
30
37
33
34
16
35
95
80
38
32
85
90
40
96
82

SOLENOID FOR AN ELECTRIC STARTING MOTOR FOR GARDEN TRACTOR OR THE LIKE

It is increasingly common to provide an electric starter on various household and garden appliances such as garden tractors, lawn mowers, snow blowers and the like driven by gasoline engines of the usual low horsepower rating. In order to keep the load current leads as short as possible and to permit remote pushbutton operation, commercially available starter solenoids have been used. Such solenoids, intended for automotive usage, are expensive and are much larger than really required for starting engines of only a few horsepower. In an effort to develop a selenoid having a current capacity tailored to the application, attempts were originally made simply to scale down the dimensions of the large automotive solenoids in accordance with the reduction in load current while keeping the design and relative proportions the same. When this proved to be impractical, thought was given to alternate constructions differing from the usual automotive solenoids and having features and advantages, and a degree of economy, more suited to the starting of small engines.

Accordingly, it is an object of the invention to provide a solenoid for a starting motor in a garden tractor or the like which consists of a minimum number of parts, simply formed, and easily assembled to produce an extremely light and compact unit having high current capability which is reliable and long lived, requiring neither care nor periodic maintenance.

It is another object to provide a solenoid for a garden tractor or similar machine which is highly durable in the face of the severe shock and vibration encountered in such usage, which is capable of mounting in any position and which is permanently sealed against entry of moisture or dirt.

It is another object to provide a device of the above type which is electrically highly efficient producing high contact pressures per unit area but which is capable of operating with only low values of control current and which remains cool in spite of in-rush and the passage of starting currents which, in the case of a recalcitrant engine, may have to be sustained for long periods of time. It is a particular object of the present invention to provide a contact arrangement which does not require use of noble metals, with their attendant cost, and which relies instead upon fixed and movable contacts of copper so constructed and arranged as to withstand the extremely high in-rush currents characteristic of starting service while avoiding any tendency for fusing to occur in localized contact areas. Indeed, it is an object to provide a contact assembly in which both the conductive disc and fixed contacts which it engages have a substantial axial thickness to provide high heat capacity as well as high thermal and electrical conductivity to minimize $I^2R$ loss and for promptly conducting the heat produced by any such loss safely outside of the confined enclosure.

It is another object of the invention to provide a starter solenoid which in spite of its small size and inherent compactness is capable of operating over many thousands of starting cycles, the conductive disc being freely rotatable with respect to the fixed contacts so that contact occurs in random positions at the edge of the disc for constant renewal of the contacting surface over the life of the device. It is yet another object to provide a starter solenoid of highly economical "sub-assembly" construction which is capable of use universally on a wide range of low horsepower engine driven devices.

Other objects and advantages of the invention will become apparent upon reading the attached detailed description and upon reference to the drawings in which.

While the invention has been described in connection with a preferred embodiment, it will be understood that we do not intend to be limited to the particular embodiment but intend, on the contrary, to cover the various alternative and equivalent constructions included within the spirit and scope of the appended claims.

Figure 1:
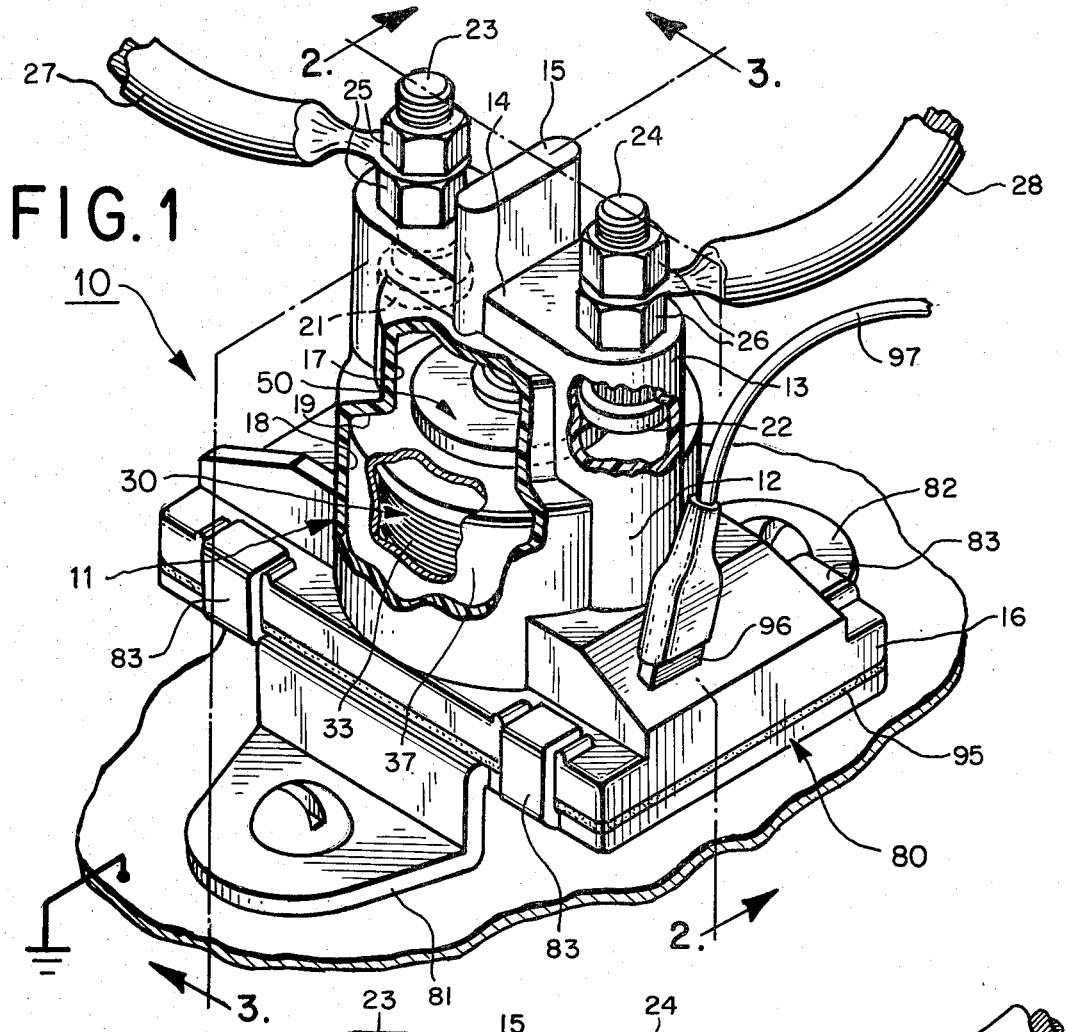
FIG. 1 is a perspective view of a solenoid constructed in accordance with the present invention with portions broken away to reveal the internal construction.
Figure 2:
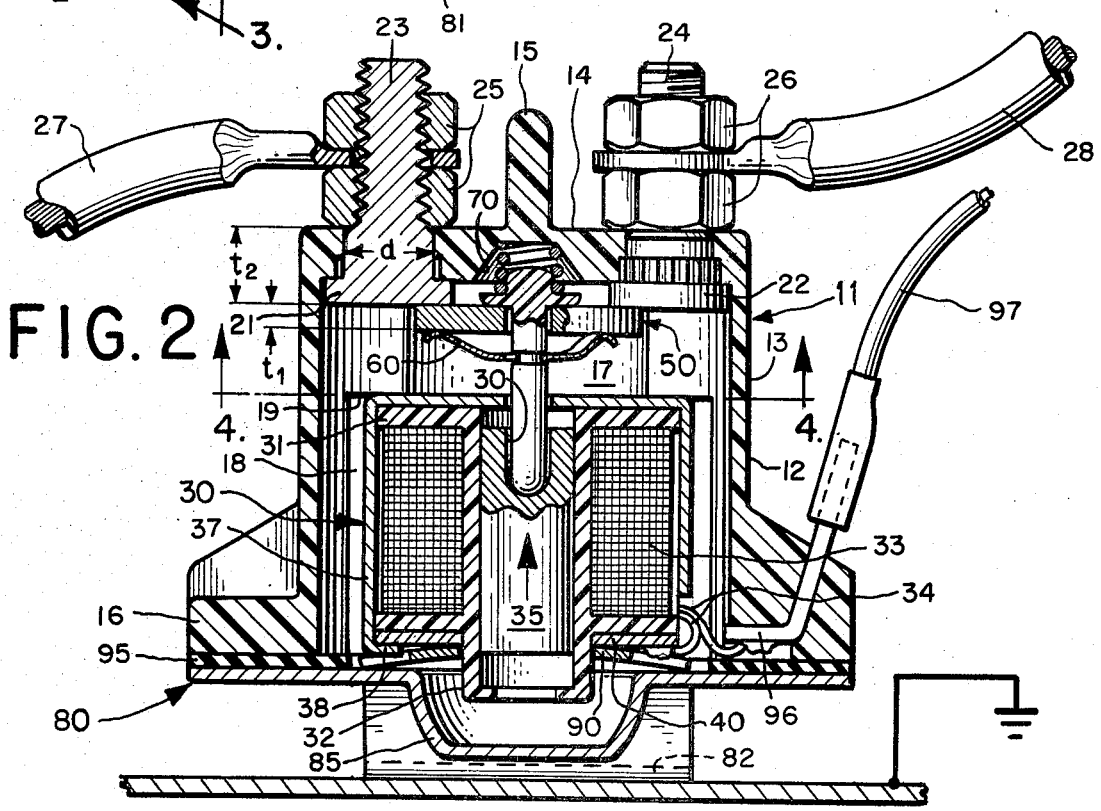
FIG. 2 is a transverse section taken along line 2—2 in FIG. 1 showing the solenoid in its energized, contact-closing, state.
Figure 3:
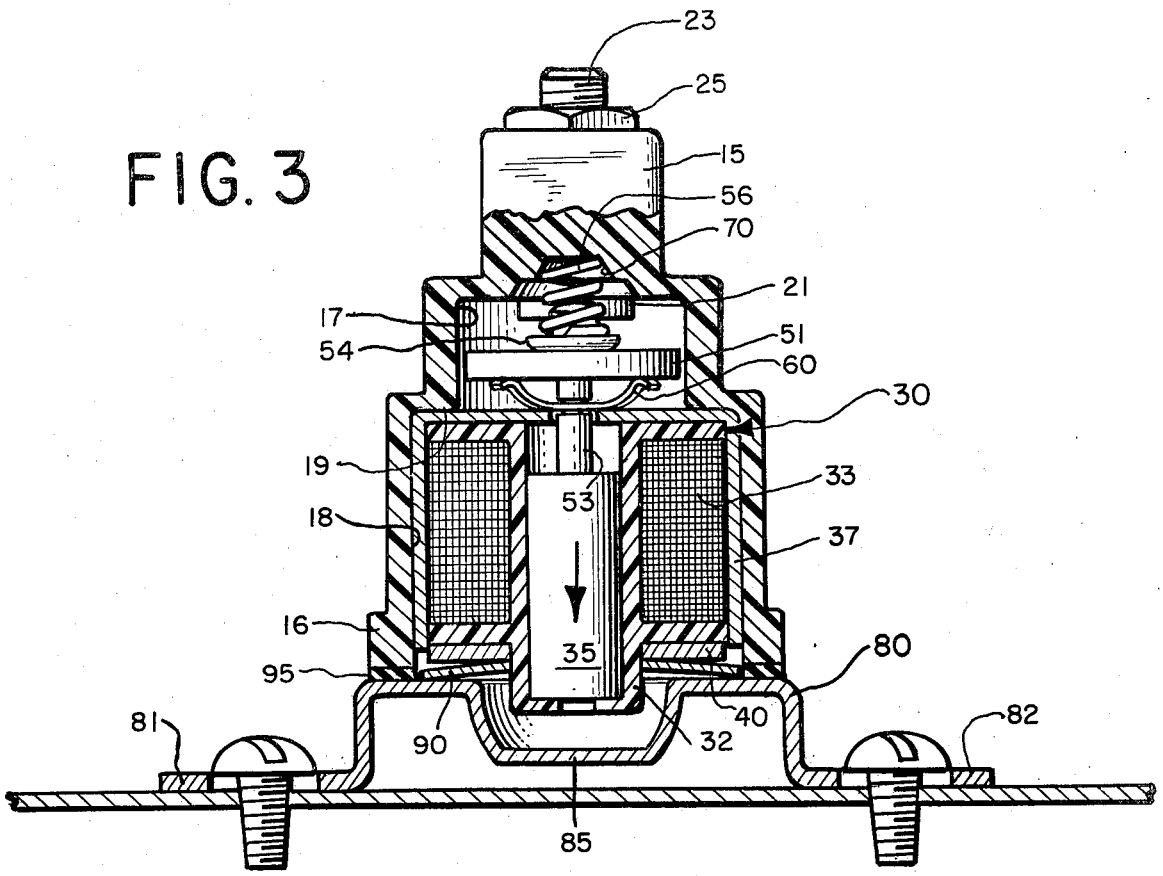
FIG. 3 is a transverse section taken along line 3—3 in FIG. 1 at right angles to the previous figure.
Figure 4:
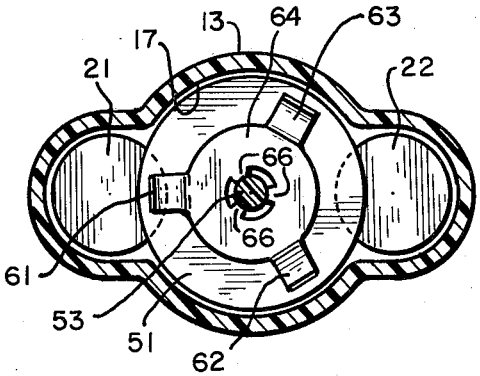
FIG. 4 is a horizontal section taken along line 4—4 in FIG. 2 looking upwardly into the head space.

Turning now to the drawings and particularly to FIGS. 1-3 there is shown a solenoid 10 for an electric starting motor including a housing 11 in the form of a cup of generally cylindrical shape molded of durable heat resistant plastic. The housing has a lower side wall 12, an upper side wall 13, and a top or end wall 14 which includes an integral barrier 15. At its lower, or open, end, the cup has an outwardly extending flange 16. The housing is of stepped cylindrical construction having a first, or upper, cylindrical chamber 17 and a second cylindrical chamber 18 of larger diameter, the second cylindrical chamber being defined by an internal annular shoulder 19, to which further reference will be made.

Penetrating the upper end wall in diametrical positions are a pair of fixed contacts 21, 22 having faces which lie in a common plane. The contacts have a substantial cross sectional diameter d and are externally threaded as indicated at 23, 24 to form binding posts having nuts 25, 26 to which are secured lengths of heavy starting cable 27, 28.

Figure 5:
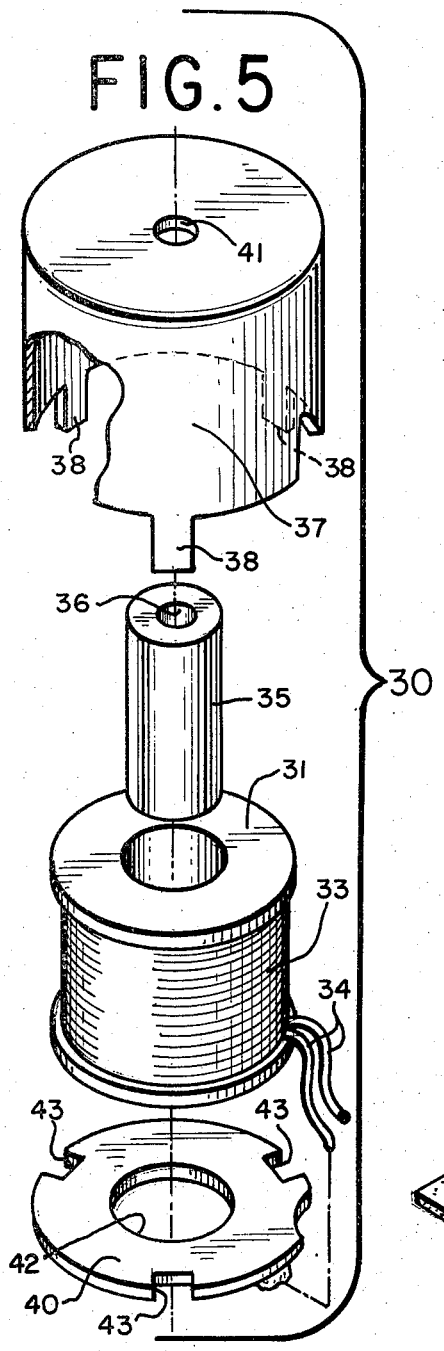
FIG. 5 is an exploded view of the electromagnetic sub-assembly.

Mounted in the lower chamber 18 of the housing is a magnetic sub-assembly as shown, for example, in FIGS. 2, 3 and 5. The assembly, indicated generally at 30, includes a bobbin 31 having a tubular extension 32 and a winding 33 of insulated copper wire terminating in leads 34. Axially slidable in the bobbin is an armature 35 in the form of a cylindrically shaped piece of magnetic material having an axial recess 36. The bobbin is completely surrounded by a hollow magnetic annulus. The annulus is formed by a drawn cup 37 of magnetic material, preferably soft steel, having integral bendable tabs 38. The drawn cup 37 is enclosed, at its open end, by a washer-shaped piece of magnetic material 40. The drawn cup and the washer have axial clearance openings 41, 42, respectively, the clearance opening 42 being of larger size to permit outward projection of the tubular extension 32 of the bobbin. The washer 40 has spaced notches 43 formed about its periphery registering with the tabs 38 so that when the tabs are bent over into the notches and against the washer, a hollow annulus results which is tight and magnetically efficient.

Figure 6:
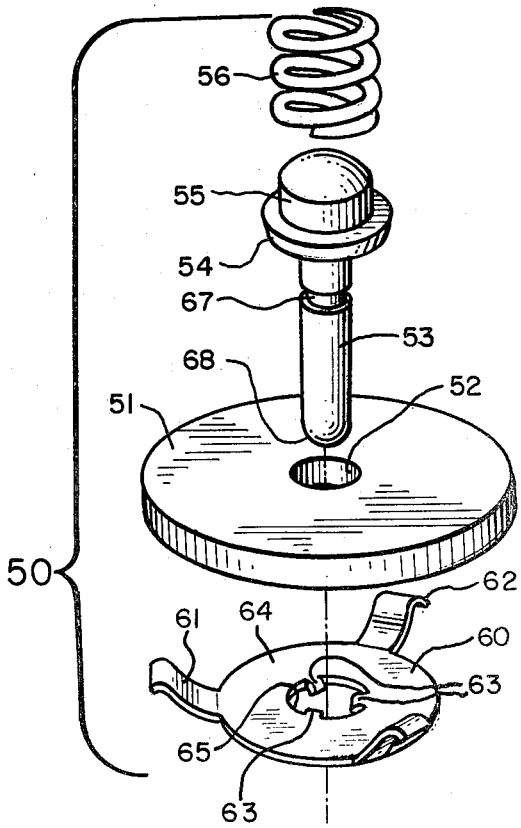
FIG. 6 is an exploded view of the movable disc contact sub-assembly.

Arranged above the magnetic sub-assembly 30 is a movable contact sub-assembly indicated at 50 (see especially FIG. 6). The contact sub-assembly includes a conductive disc 51 having a central clearance opening 52. Extending through the clearance opening is a plunger 53 having at its upper end an annular shoulder, or flange, 54 and an adjacent hub 55. Secured to the hub, and frictionally engaged with it to form a cantilevered extension, is a coil return spring 56.

In accordance with one of the features of the invention the conductive disc is only loosely fitted on the plunger 53, by reason of using an oversized clearance hole 52, and a leaf spring in the form of a spider is secured to the plunger for pressing the disc upwardly against the flange 54, that is in the direction of the contacts 21, 22. The leaf spring, indicated at 60, has three spring arms, 61–63, integrally joined to a circular body 64 having a central opening 65 lined by a set of downwardly angled lugs 66. The lugs are dimensioned to snap into an annular groove 67 formed in the plunger.

The parts illustrated in FIG. 6, therefore, form a convenient sub-assembly: First the spring 56 is forcibly assembly on the hub 55, being retained thereon by friction. The disc 51 is then slipped over the plunger against the flange 54 where it is seated followed by telescoping of the leaf spring 60 over the plunger until the inwardly directed lugs 66 snap into the annular groove 67, which holds the assembly together. The lower end of the plunger is rounded as shown at 68 for seating in the axial recess 36 in the armature, passage being permitted by the adjacent axial clearance opening 41 at the upper end of the magnetic annulus.

Figure 7:
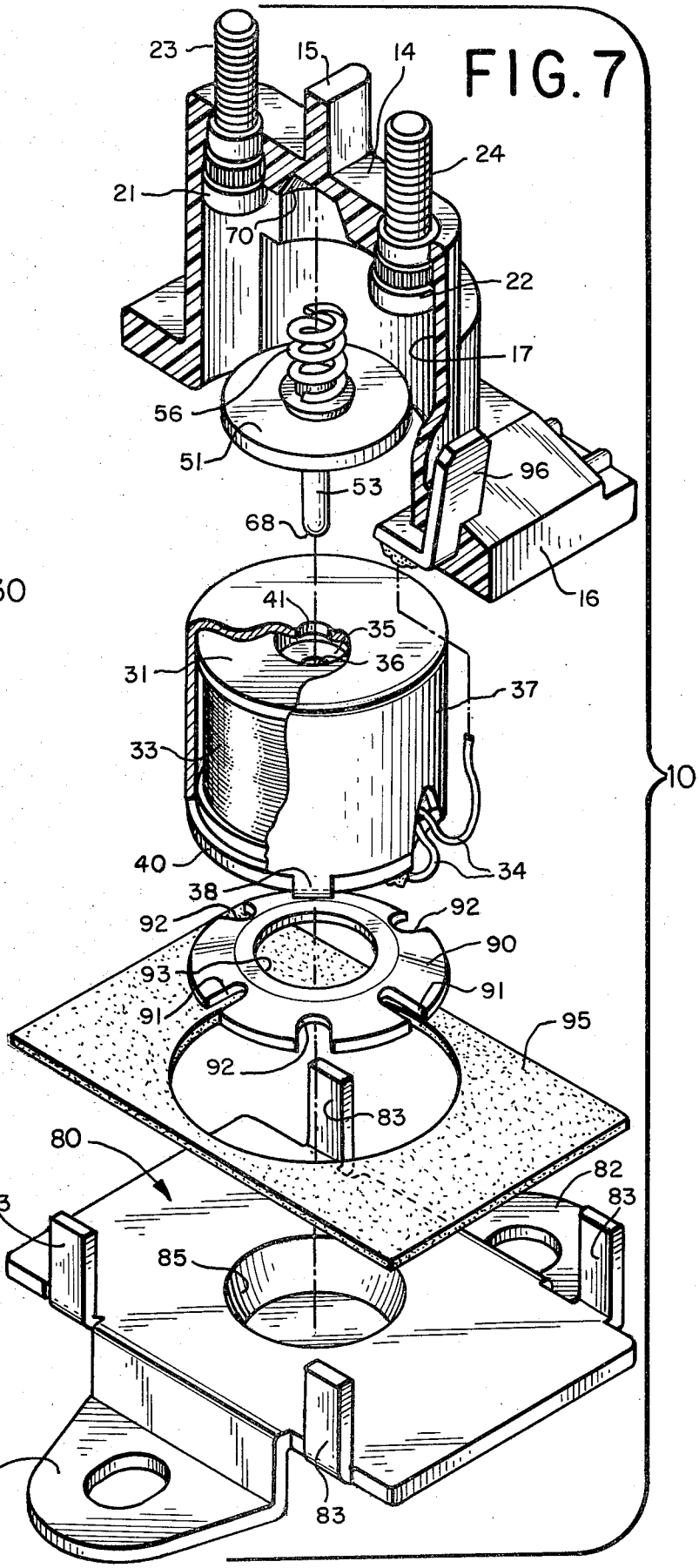
FIG. 7 is an exploded view of the device as a whole.

For the purpose of maintaining the return spring 56 as well as the plunger 53 and its disc 51 centered with respect to the end wall of the housing, a recess 70 lying in a frustoconical locus is molded in the end wall 14 as shown, for example, in FIGS. 2, 3 and 7. Since the coil return spring 56 is tightly anchored to the hub 55 of the plunger, forming a cantilevered extension of it, the centering of the spring in the housing also insures that the plunger is resiliently maintained in a centered position.

At its lower end the plunger is also maintained in centered position by reasons of its engagement with the recess 36 in the armature. It will be understood, however, that the recess 36 is intentionally oversized to permit slight relative rocking movement of the plunger as the conductive disc thereon aligns itself with the engaged fixed contacts.

For enclosing the open lower end of the housing a metal mounting plate 80 is provided having a profile which conforms to the shape of the flange 16 of the housing and which has integral, diametrically positioned standoff legs 81, 82. Moreover, the mounting plate has a plurality of clamping lugs 83, preferably four in number, about its periphery capable of bending upwardly about the edge of the flange into a clamping position. At its center the mounting plate 80 has a central depression 85 for accommodating the tubular extension 32 of the bobbin, in other words, for accommodating the armature 35 when it is in its retracted, lower, position.

In accordance with one of the features of the invention there is provided, between the mounting plate and the magnetic annulus, and in thermal engagement with both of them, a concaved spring washer of conductive metal. Such spring washer, indicated at 90, is provided with peripheral slots 91, for resilience, as well as with peripheral notches 92 for the purpose of clearing the bent-over lugs 38 of the magnetic cup member 37. The spring washer 90 is provided with a central clearance opening 93 adequate to accommodate the tubular extension 32 of the bobbin. The washer is oriented, as shown in FIG. 2, concaved downwardly so that the central portion is in intimate contact with the magnetic annulus, and particularly with the closure member 40 thereof, while the periphery presses directly downwardly against the mounting plate, thereby providing a direct path for heat flow from the coil to the mounting plate and thence, through the legs 81, 82 to the supporting structure which is thereby utilized as a heat sink. The reaction force of the spring washer 90 not only insures intimate contact at the heat transferring surfaces but also insures that the magnetic annulus remains firmly and resiliently seated upon the internal annular shoulder 19.

Surrounding the conductive spring washer 90 and sandwiched between the flange 16 and mounting plate 80 is a resilient gasket 95. When the lugs 83 on the mounting plate are bent, or crimped, inwardly, the resilient washer 90 and the gasket 95 are simultaneously compressed, the first to develop the reaction force already referred to and the second serving to seal the unit against the entry of dirt and moisture.

Assembly of the structure is particularly convenient and economical. The contacts 21, 22 are first pressed into position in which they project through the end wall. They are dimensioned and knurled for a press fit and may be readily drawn into position by tightening the lowermost ones of the nuts 25, 26.

The contact sub-assembly 50, illustrated in FIG. 6, is then dropped into position, with the housing inverted, so that the end of the spring settles, by itself, into a centered position in the frustoconical recess 70.

The magnetic sub-assembly of FIG. 5 is next pressed into its position in cylindrical chamber 18 seated against the internal shoulder 19. This is followed by insertion of the spring disc 90.

At this point the "free" one of the leads 34 may be soldered to a lug 96 (FIG. 2) leading to the control circuit 97, the other lead having been soldered to the annulus.

Finally, the mounting plate and its associated gasket may be assembled over the flange 16 and lugs 83 bent over, or crimped, which draws the whole assembly up-tight, simultaneously compressing the resilient spring 90 and gasket 95, as already mentioned.

In accordance with one of the features of the present invention, the conductive disc 51 and the fixed contacts 21, 22 both have substantial axial and radial thickness to provide a high heat capacity and are formed of a metal having high conductivity for flow of heat to the binding posts 23, 24 where the heavy cables 27, 28 serve as a heat sink. Further in accordance with the invention the fixed contacts are spaced from the disc axis at a sufficient distance so that only a portion, preferably one-quarter or less, of the presented area of the fixed contacts is engaged by the edge portion of the disc thereby to develop a high contact pressure per unit area.

As a result, when the coil is energized to raise the disc into engagement with the fixed contacts 21, 22 the force of the magnetic assembly, acting on only the relatively small area in contact, produces higher contact pressures than are achieved in more conventional constructions so that high in-rush current followed by high sustained cranking current can flow through the device, with the contact surfaces providing such low resistance so that $I^2R$ loss is kept to a minimum. This is notwithstanding the fact that the heat generated tends to increase as the square of the current. Low resistance is achieved in the present construction using copper or copper alloy without necessity for resorting to noble metals such as the silver or silver alloy which has been commonly employed in the past.

Not only has contact resistance been kept low but the disc and fixed contacts are intentionally made of substantial axial thickness (as indicated at t1 and t2, respectively) so that there is a volume of conducting material immediately adjacent the contacting surfaces. Thus any heat which may be developed at the contacting surfaces, particularly later in the life of the device when the surfaces are no longer bright, is immediately dissipated throughout the volume of conductor. Equalization of temperature throughout such volume occurs almost immediately preventing any development of localized high temperature as might occur, for example, due to a severe in-rush. Moreover, and heat passing into the contacts 21, 22 is immediately conducted to the outside of the device and into the heavy cables 27, 28, while heat developed in the coil is conducted into the mounting plate.

As a result, the unit, although made in extremely small size, say, one-quarter of the size of conventional automotive solenoids, is nevertheless capable of handling peak starting currents which approach those encountered in automotive practice.

It is a further feature of the construction that the disc 51 is freely rotatable with respect to the fixed contacts 21, 22 so that contact with the fixed contacts occurs in random positions on the edge of the disc. This provides constant renewal of the contacting surfaces, making the life of the device almost indefinite. However, while it is preferred to use a disc which is circular, and therefore symmetrical about an axis, it will be understood that the invention, in one of its aspects, is not limited to use of a disc member 51 of circular shape and the shape may be varied as desired provided bridging contact is achieved and without departing from the broader aspects of the invention.

While the operation of the device will be apparent from the foregoing description, a typical operating cycle may be considered. When current is applied to the winding 33 through control line 96, the solenoid armature 35 is strongly sucked into the magnetic annulus. Because the coil is entirely surrounded by a magnetic material, a large thrust may be obtained, a thrust which is at a reliably high level over the entire upward stroke. This force, overcoming the force of the return coil spring 56, causes the plunger to move upwardly so that the equalizing spring 60 thereon presses the disc into simultaneous contact with fixed contacts 21, 22. It is one of the features of the present construction that the device is operative without adhering to close tolerances. Thus if the contacts 21, 22 happen to be located at a slightly different level, the disc 51 is free to cock through a small angle, with such cocking motion accommodated by the equalizing spring 60. The disc, applying high per unit pressures to the contact surfaces 21, 22 serves as an efficient and low resistance bridge between the binding posts, closing a starting circuit between the cables 27, 28 and energizing the starter to start the engine. As stated, not only is high in-rush accommodated but long cranking cycles may be tolerated, with any heat first being promptly dissipated throughout the mass of conductor and, secondly, conducted safely to the ambient surroundings.

While it is one of the features of the construction described above that the concave washer 90 provides both thermal and electrical conductivity between the magnetic annulus and the mounting plate, such conductivity may be enhanced by adjusting the geometry, for example, by shimming at the shoulder 19 to provide for simultaneous contact, or bottoming, between the bent-over lugs 38 on the annulus and the mounting plate 80. As an alternative to use of a shim, the concaved washer 90 may be moved to a position above the annulus, that is, sandwiched between the annulus and the shoulder 19, to provide bias for pressing the annulus downwardly into firm thermal and electrical contact with the mounting plate. In a somewhat simplified construction the concaved washer may be omitted from the construction and the effective height of the annulus chamber adjusted, either by shimming or by adjusting gasket thickness, so that clamping up the lugs 83 causes the lugs 38 of the annulus to be in direct heat transmitting relation with the mounting plate.

What we claim is:

1. A solenoid for an electric starting motor for a garden tractor or the like comprising, in combination a housing in the form of a generally cylindrical inverted cup of molded plastic having a closed end wall and having an outwardly extending flange at its open end, a pair of diametrically arranged fixed contacts having a substantial cross section penetrating the end wall and being threaded externally thereof to form binding posts for a load circuit, a magnetic assembly including a cylindrical wound bobbin having an armature axially slidable therein with the bobbin being completely surrounded by a hollow magnetic annulus having axial clearance openings at its respective ends, means for holding the annulus axially within the open end of the cup, a movable contact assembly including a conductive disc for completing a circuit between the fixed contacts and having an axial plunger which projects from one side of the disc through the adjacent one of the clearance openings in the annulus and also having a return coil spring extending axially from the opposite side of the disc to the end wall, the end of the plunger being seated against the adjacent end of the armature, the armature when in its normal retracted position extending through the remote one of the clearance openings to a position outside of the annulus so that when control current is applied to the winding on the bobbin the armature is sucked into the annulus overcoming the force of the return spring and shifting the conductive disc into seated engagement with the fixed contacts thereby completing the load circuit, the disc and fixed contacts both having substantial axial thickness to provide high heat capacity and formed of a metal having high conductivity for flow of heat to the binding posts thereby to reduce the rise in temperature within the housing, the fixed contacts being spaced from the disc axis at a sufficient distance so that only a portion of the presented area of the fixed contacts is engaged by the edge portion of the disc thereby to develop a high contact pressure per unit area, the disc being freely rotatable with respect to the fixed contacts so that contact with the latter occurs in random positions on the disc for constant renewal of the contacting surface thereon.

2. The combination as claimed in claim 1 in which the disc is loosely fitted on the plunger and in which a leaf spring is telescoped over the plunger for pressing the disc in the direction of the fixed contacts, the leaf spring being in the form of a spider having legs surrounding a central opening for engaging an annular groove in the plunger and having a plurality of radially-extending legs bearing against the disc for accommodating slight relative cocking movement of the latter thereby to equalize the contact forces exerted by the disc upon the fixed contacts.

3. The combination as claimed in claim 1 in which the cup-shaped housing is of stepped construction having a first cylindrical chamber adjacent the end wall, the fixed contacts being substantially flush with the end wall, the first cylindrical chamber being dimensioned to freely accommodate the conductive disc, the housing having a second cylindrical chamber of larger diameter adjacent the first cylindrical chamber for snugly accommodating the magnetic annulus, the second cylindrical chamber being defined by an internal shoulder in the housing, and means including a mounting plate secured on the flange for urging the annulus into bottomed engagement with the shoulder.

4. The combination as claimed in claim 1 in which a metal mounting plate is provided in area engagement with the flange on the cup, an annular shoulder on the inner wall of the cup, a concaved spring washer of conductive metal being sandwiched between the annulus and the mounting plate for providing good thermal coupling between the annulus and the plate for transmission of heat to the latter while at the same time keeping the annulus in a bottomed relation with the shoulder in the cup.

5. The combination as set forth in claim 4 in which the mounting plate has a profile conforming to the flange at the open end of the housing, the mounting plate having a plurality of lugs about its periphery capable of bending inwardly about the edge of the flange into a clamping position, and a resilient gasket interposed between the mounting plate and the flange so that when the lugs are bent into clamping position the resilient washer and the gasket are simultaneously compressed thereby seating the annulus and forming a water-tight seal at the gasket.

6. The combination as claimed in claim 1 in which a metal mounting plate is provided in area engagement with the flange on the cup, the mounting plate having legs providing stand-off support, the mounting plate having a central depression for accommodating the end of the armature when the latter occupies its retracted position, and stop means for limiting movement of the armature in the retract direction.

7. The combination as claimed in claim 1 in which a recess for the return coil spring is centered within the end wall of the housing, the recess lying in a frustoconical locus for guiding the coil spring, and maintaining it, in a centered position in the cup, the coil spring being joined to the end of the plunger to form a cantilevered extension thereof so that the plunger is resiliently maintained in a centered position.

8. The combination as claimed in claim 1 in which the presented end of the armature has an axial recess, the end of the plunger being telescoped into the recess, the recess being sufficiently oversized as to permit limited relative rocking movement of the plunger as the conductive disc thereon aligns itself with the engaged fixed contacts.

9. The combination as claimed in claim 1 in which the fixed contacts are spaced with respect to the disc so that less than one-quarter of the presented area of each such contact is engaged by the edge portion of the disc.

10. The combination as claimed in claim 1 in which a metal mounting plate is provided in area engagement with the flange on the cup, an annular shoulder on the inner wall of the cup, and a spring washer sandwiched between the shoulder and the annulus for pressing the annulus downwardly against the mounting plate for good thermal coupling with the latter.

11. The combination as claimed in claim 1 in which a metal mounting plate is provided in area engagement with the flange of the cup to enclose the opening at the end of the cup, an annularly extending shoulder on the inner wall of the cup, the annulus having a set of integral downwardly projecting lugs spaced about the bottom edge thereof, a resilient gasket interposed between the mounting plate and the flange, and means for clamping the mounting plate to the flange for squeezing of the gasket, the thickness of the gasket being such in its squeezed condition that the lugs are in intimate heat transferring relation to the mounting plate.

12. The combination as claimed in claim 1 in which the disc is loosely fitted on the plunger and in which a spring is telescoped over the plunger for pressing the disc in the direction of the fixed contacts, the spring having a central opening for engaging an annular groove in the plunger and having a radially-extending portion bearing against the disc for accommodating slight relative cocking movement of the latter thereby to equalize the contact forces exerted by the disc upon the fixed contacts.

13. The combination as set forth in claim 1 in which a mounting plate is provided conforming to the flange at the open end of the cup, the mounting plate having a plurality of fasteners spaced about its periphery capable of being deformed to clamp the mounting plate against the edge of the flange, a resilient spacer interposed between the mounting plate and the annulus, and a resilient gasket interposed between the mounting plate and the flange so that when the fasteners are deformed into clamping condition the resilient spacer and the gasket are simultaneously compressed thereby seating the annulus and forming a water-tight seal at the gasket.

14. A solenoid for an electric starting motor for a garden tractor or the like comprising, in combination a housing in the form of a generally cylindrical inverted cup of molded plastic having a closed upper end wall and having an outwardly extending flange at its lower open end, a pair of diametrically spaced fixed contacts having substantial cross sectional thickness penetrating the end wall and being threaded externally thereof to form binding posts for a load circuit, a magnetic assembly including a cylindrical wound bobbin having an armature axially slidable therein with the bobbin being completely surrounded by a hollow magnetic annulus having axial clearance openings at its respective ends, a movable contact assembly including a conductive disc for completing a circuit between the fixed contacts and having an axial plunger which projects from one side of the disc through the adjacent one of the clearance openings in the annulus and also having a return spring extending from the opposite side of the disc to the end wall, the end of the plunger being seated against the adjacent end of the armature to provide a thrust connection, the armature when in its normal retracted position extending through the remote one of the clearance openings to a position outside of the annulus so that when control current is applied to the winding on the bobbin the armature is sucked into the annulus overcoming the force of the return spring and shifting the conductive disc into seated engagement with the fixed contacts thereby completing the load circuit, the disc and fixed contacts both having substantial axial thickness to provide high heat capacity and formed of a metal having high conductivity for flow of heat to the binding posts thereby to reduce the rise in temperature within the housing, the fixed contacts being spaced from the disc axis at a sufficient distance so that only a portion of the presented area of the fixed contacts is engaged by the edge portion of the disc thereby to develop a high contact pressure per unit area in response to thrust from the armature, a metal mounting plate having means for securing the same to the flange for enclosing the open end of the cup and having an integral mounting bracket, the annulus having a lower disc member of washer shape, the outer edge of the lower disc member being notched to define peripherally spaced radially extending legs, the legs being downwardly sprung against the mounting plate tending to urge the annulus upwardly into a seated position within the cup and providing good thermal coupling between the annulus and the plate for completing a thermally conductive path for flow of heat from the winding in the annulus to the mounting bracket.

* * * * *